US005158292A

United States Patent [19]

Hanchar

[11] Patent Number: 5,158,292

[45] Date of Patent: Oct. 27, 1992

[54] PIVOTING GATE AND TARGET ASSEMBLY FOR A PINBALL MACHINE

[75] Inventor: Peter J. Hanchar, Chicago, Ill.

[73] Assignee: Premier Technology, Bensenville, Ill.

[21] Appl. No.: 742,616

[22] Filed: Aug. 8, 1991

[51] Int. Cl.[5] ..... A63F 7/30

[52] U.S. Cl. ..... 273/121 A; 273/127 R; 273/127 D

[58] Field of Search ..... 273/118-125, 273/127

[56] References Cited

U.S. PATENT DOCUMENTS

| | | | |
|---|---|---|---|
| 3,578,802 | 5/1971 | Murphy et al. | 273/121 A X |
| 4,620,706 | 11/1986 | Ijidakinro | 273/127 R X |
| 4,773,646 | 9/1988 | Joos, Jr. et al. | 273/121 A |
| 4,804,186 | 2/1989 | Moravec | 273/127 R |
| 4,934,699 | 6/1990 | Kaminkow et al. | 273/121 A |
| 4,943,061 | 7/1990 | Grabel | 273/127 R |
| 4,968,031 | 11/1990 | Kaminkow et al. | 273/121 A |
| 4,981,298 | 1/1991 | Lawlor et al. | 273/121 A |

*Primary Examiner*—Paul E. Shapiro

*Assistant Examiner*—Raleigh W. Chiu

*Attorney, Agent, or Firm*—Arnold, White & Durkee

[57] ABSTRACT

A gate and target assembly is raised from a first position, wherein a target is positioned in a channel on a playfield to interfere with passage of a ball through the channel, to a second position, wherein the target is positioned above the channel so as not to interfere with passage of the ball through the channel. In a preferred construction, a plurality of targets are pivotally mounted between two opposed upright brackets that extend from the playfield and define opposite sides of the channel, and the targets are moved from the first position to the second position by energizing a solenoid that is linked to a swinging crank pin of the assembly. Moreover, the assembly is covered by the simulated head of an animal, such as a hippopotamus, and the simulated animal head pivots up and down with the targets. A timer circuit, for example, keeps the simulated animal head up and the channel open for a predetermined period of time beginning when any one of the targets is struck. The assembly therefore provides a novel game feature to attract player interest.

17 Claims, 5 Drawing Sheets

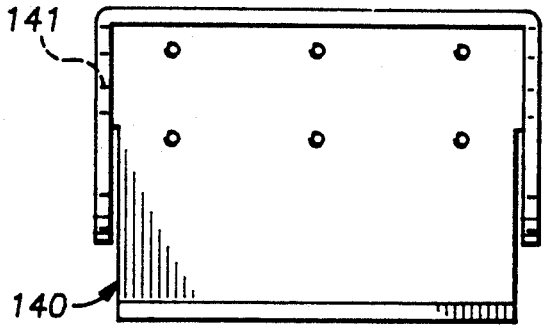
FIG. 4A
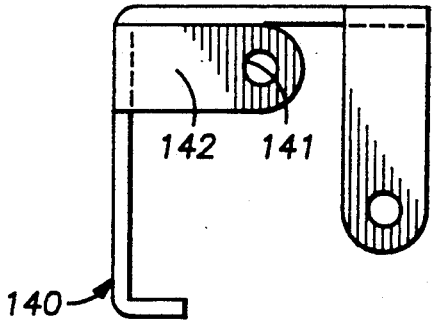
FIG. 4B
FIG. 5A
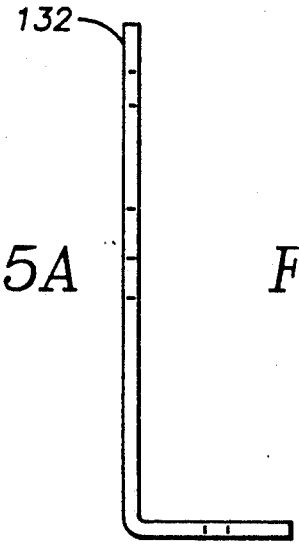
FIG. 5B
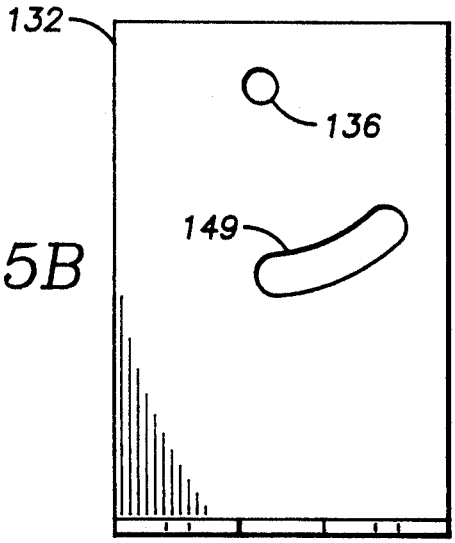
FIG. 6
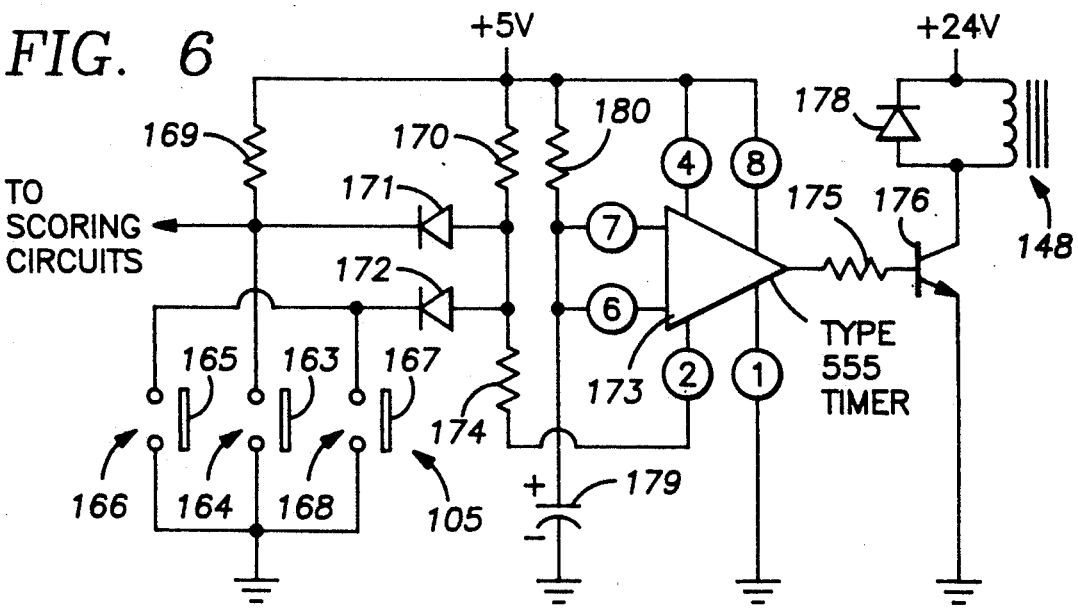

PIVOTING GATE AND TARGET ASSEMBLY FOR A PINBALL MACHINE

BACKGROUND OF THE INVENTION

1. Field of the Invention

The present invention relates generally to pinball machines, and more particularly to ball gates and targets for pinball machines. The present invention specifically relates to a target assembly of the kind that has a first position wherein a target is positioned in a channel on a playfield to close the channel, and a second position wherein the target is removed from the channel to open the channel 2. Background Art In a pinball game, a player operates flippers to direct a ball over a playfield to various targets to score points. The targets are assigned different scores, and targets having high scores are often placed in areas of the playfield that are reached only by the more skillful players. The player, for example, must direct the ball to a restricted channel on the playfield to reach the high-scoring targets.

Often a channel leading to the high-scoring targets is blocked until certain low-scoring targets are struck. One known way of blocking such a channel is to place a drop target assembly in the channel. A suitable drop target assembly, for example, is described in Moravec, U.S. Pat. No. 4,804,186. At the start of a game, the drop targets are raised to block the channel. When a drop target is struck by the ball, it drops beneath the playfield to provide an opening through the channel.

Pivoting visors and gate ramps have also been used in pinball machines in order to provide various types of play features. Joos, Jr. et al., U.S. Pat. No. 4,773,646, for example, shows a plurality of targets mounted on a target carrier. The target carrier can be raised above the surface of the playfield where the targets can be hit by a ball or lowered below the playfield so that the ball will pass over the targets. Located behind this first set of targets on the playfield is a second set of targets. The second set of targets is either covered by a visor or exposed to be contacted by a ball. The visor is operatively connected to the target carrier such that the downward movement of the target carrier results in upward movement of the visor. In this manner, the two target areas are alternatively exposed to the player to vary the scoring opportunities.

A pivoting gate-ramp is described in Kaminkow et al., U.S. Pat. No. 4,934,699. The ramp carries targets and provides a gate-like covering for an opening and passage to other targets and areas of the playfield. When a ball traveling up the ramp strikes a target carried by the ramp, the ramp is pivoted to its open position revealing an opening and passage to other targets and areas of the game.

SUMMARY OF THE INVENTION

The present invention provides a gate and target assembly that is raised from a first position, wherein a target is positioned in a channel on a playfield to interfere with passage of a ball through the channel, to a second position, wherein the target is positioned above the channel so as not to interfere with passage of the ball through the channel.

In a preferred construction, a plurality of targets are pivotally mounted between two opposed upright brackets that extend from the playfield and define opposite sides of the channel, and the targets are moved from the first position to the second position by energizing a solenoid that is linked to a swinging crank pin of the assembly. Moreover, the assembly is covered by a cover resembling the head of an animal, such as a hippopotamus, and the simulated animal head pivots up and down with the targets. A timer circuit, for example, keeps the simulated animal head up and the channel open for a predetermined period of time after any one of the targets is struck. The assembly therefore provides a novel game feature to attract player interest.

BRIEF DESCRIPTION OF THE DRAWINGS

Other objects and advantages of the invention will become apparent upon reading the following detailed description with reference to the accompanying drawings wherein:

FIGS. 4A and 4B are front and side views, respectively, of a pivoting bracket used in the preferred construction of the present invention;

FIGS. 5A and 5B are front and side views, respectively, of an upstanding support used in the preferred construction of the present invention; and FIG. 6 is a schematic diagram of a timer circuit that may be used for supplying an actuating signal for a predetermined duration of time beginning when a target is struck.

Figure 1:
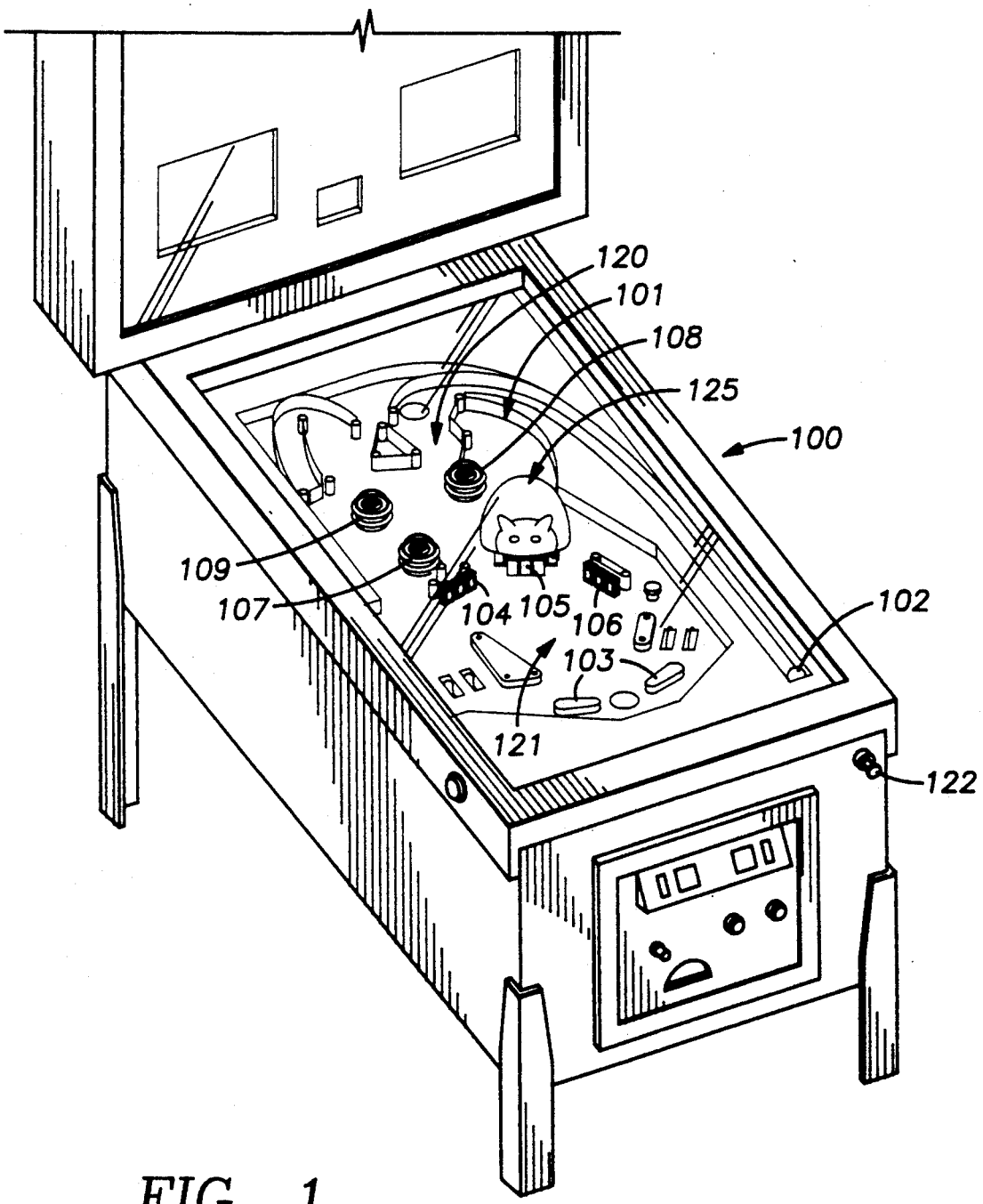
FIG. 1 is a perspective view of a pinball machine incorporating the present invention.

While the invention is susceptible to various modifications and alternative forms, a specific embodiment thereof has been shown in the drawings and will be described in detail. It should be understood, however, that it is not intended to limit the invention to the particular form shown, but on the contrary, the intention is to cover all modifications, equivalents, and alternatives falling within the scope of the invention as defined by the appended claims.

DETAILED DESCRIPTION OF THE PREFERRED EMBODIMENT

Turning now to FIG. 1 of the drawings, there is shown a pinball machine 100 employing the present invention. The pinball machine 100 has a playfield 101 over which a ball 102 travels under the influence of a player (not shown). During play, the ball 102 strikes a number of flippers 103 and targets 104, 105, 106, 107, 108, and 109. Depending upon the state of the game, the impact of the ball 102 upon a target causes the player's score to be increased (or possibly decreased) by a certain number of points. The targets 104 and 106, known as drop targets, may respond to impact with the ball 102 by dropping underneath the playfield 101. The targets 107, 108, 109, known as bumper targets, may respond to impact with the ball 102 by energizing a solenoid (not shown) to cause the ball to be ejected from the target at an increased velocity.

In the game shown in FIG. 1, the playfield is subdivided into a number of regions including a high scoring region 120 at the back of the playfield and a low scoring region 121 at the front of the playfield. The high scoring region 120, for example, is initially entered when the ball 102 is put into play by a plunger 122. In the high scoring region 120, the ball may bounce back-and-forth a number of times among the bumper targets 107, 108, and 109, causing a rapid increase in the player's score. Once the ball travels down to the low scoring region 121, however, the player must manipulate the flippers 103 to strike particular ones of the targets 104, 105, 106 to increase the score.

In accordance with an important aspect of the invention, the game shown in FIG. 1 has a pivoting gate and target assembly generally designated 125 that permits the player to direct the ball 102 from the low scoring area 121 to the high scoring area 120. The player must first direct the ball to strike one of the targets 105, which causes the pivoting gate and target assembly 125 to pivot in such a way that the targets 105 are moved from a first position in which the targets block a channel from the low scoring area 121 to the high scoring area 120, to a second position wherein the targets 105 are positioned above the channel so as not to interfere with the passage of the ball through the channel.

The mechanical details of the pivoting gate and target assembly 125 are not visible in FIG. 1, because the mechanical components are covered by a cover resembling an animal head, which in this case resemble a hippopotamus. When the simulated animal head is in a lowered position, the targets 105 block the channel. When the simulated animal head is a raised position, the targets 105 are also in a raised position so as to open the channel.

Figure 2A:
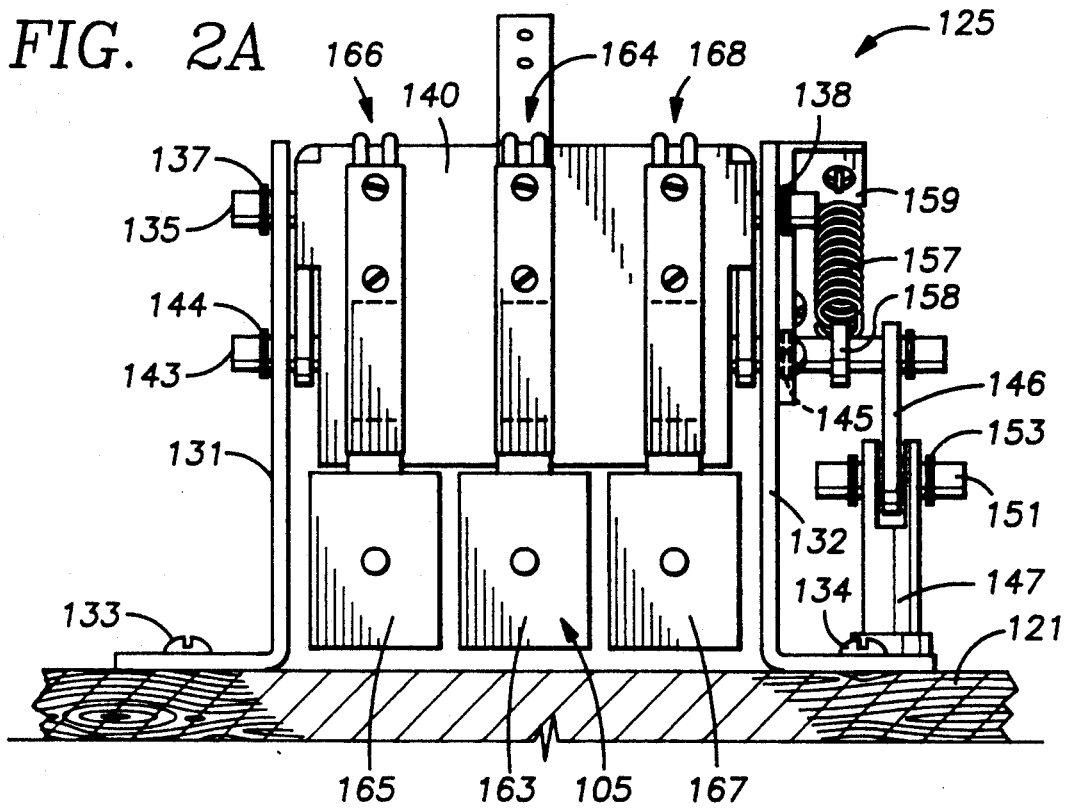
FIGS. 2A and 2B are front views of the pivoting gate and target assembly of the present invention, the pivoting gate and target assembly being shown in a first position in FIG. 2A wherein a channel is closed and a second position being shown in FIG. 2B wherein the channel is open.
Figure 2B:
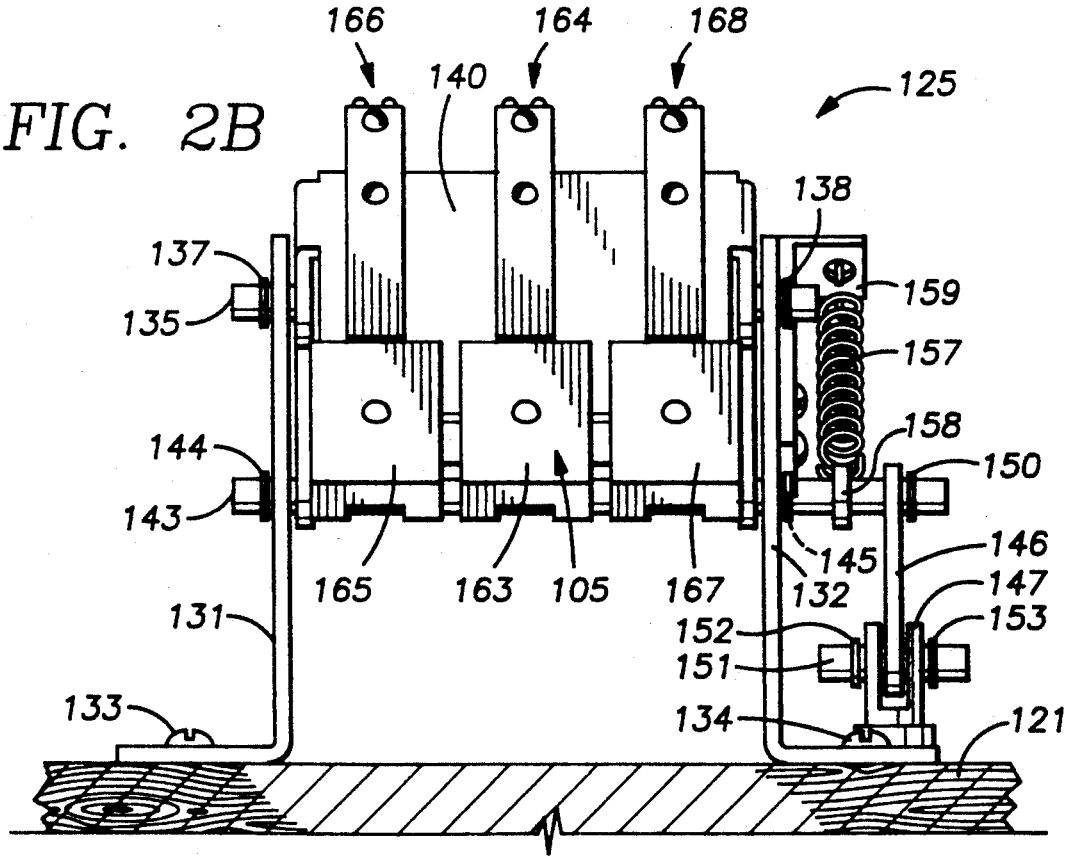

Turning now to FIGS. 2A and 2B, there is shown a front view of the mechanical components of the pivoting gate and target assembly 125. It, should be noted that in FIG. 2A and FIG. 2B, the simulated animal head, which is a molded plastic shell, has been removed so that the mechanical components are visible. The assembly 125 includes two parallel spaced upstanding support brackets 131, 132 which are fastened to the playfield by respective screws 133, 134. The support brackets 131, 132, for example, are folded from 0.094" cold rolled steel sheet metal. A pivot rod 135 extends between the supports 131, 135 and is journaled in a hole in each of the supports, such as the hole 136 in the right support 132 as shown in FIG. 5B. The pivot rod 135 is retained between the supports 131, 132 by "C" snap-rings 137, 138.

To permit movement of the targets 105 between a first position as shown in FIG. 2A and a second position as shown in FIG. 2B, the targets 105 are mounted to a pivot bracket 140 that is in turn mounted on the pivot rod 135 between the supports 131 and 132. The pivot bracket 140 has holes, such as the hole 141 in a folded tab 142 as shown in FIG. 4B, which receive the pivot rod 135. The pivot bracket 140, for example, is made of 15 gage cold rolled steel sheet metal, and is folded in a "box-and-pan brake" to the desired configuration shown in FIGS. 4A and 4B.

To raise the targets 105 from the lower position shown in FIG. 2A to the upper position shown in FIG. 2B, the pivot bracket 140 carries a swinging crank pin 143 that is retained between the supports 131, 132 by respective "C" snap rings 144, 145. The swinging crank pin 143 is connected by a link 146 to a plunger 147 of a solenoid actuator 148 which is shown in FIGS. 3A and 3B.

Figure 3A:
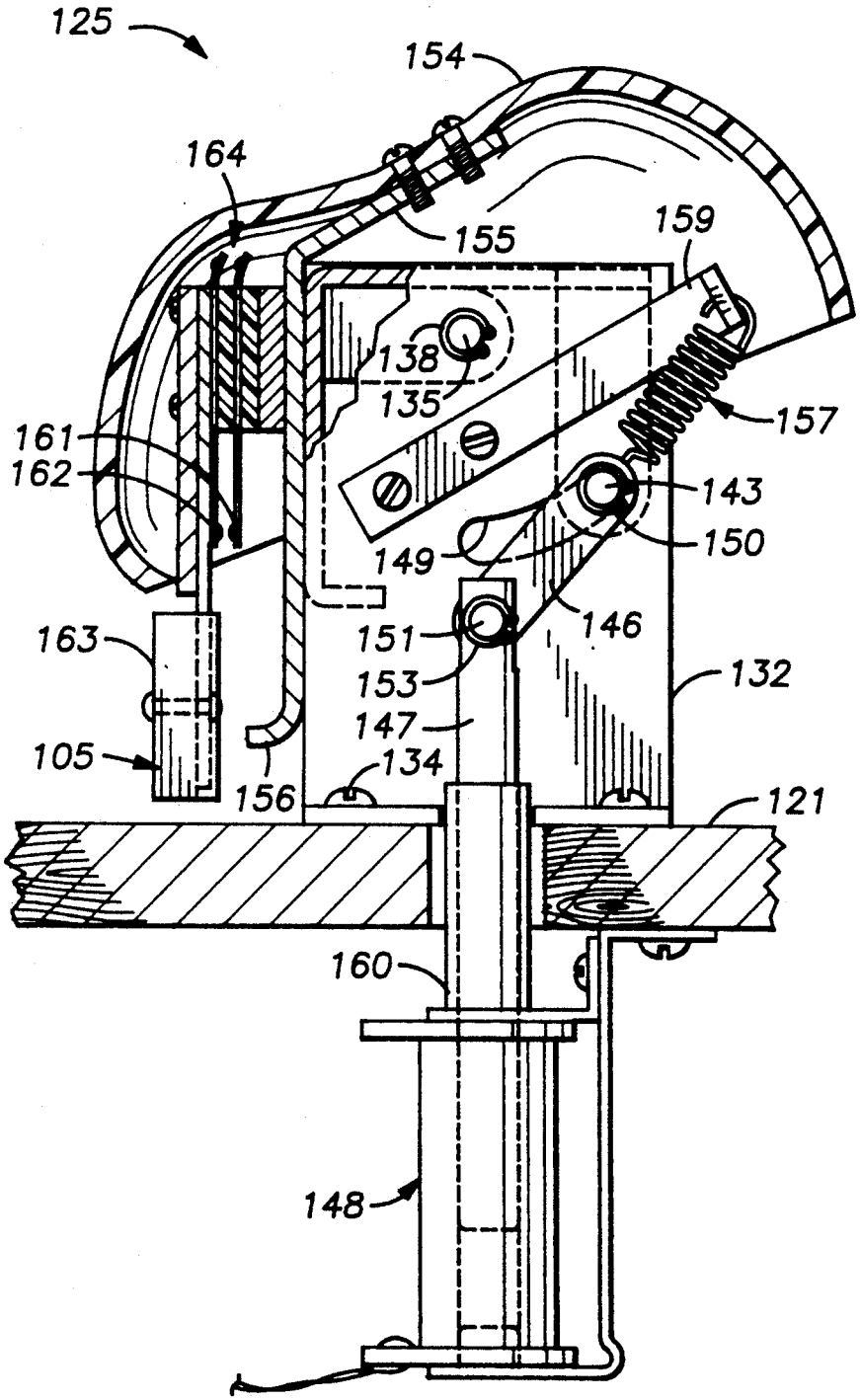
FIGS. 3A and 3B are side views of the pivoting gate and target assembly of the present invention, with the pivoting components being shown in partial section, and the pivoting components being shown in a first position in FIG. 3A wherein the channel is closed, and in a second position in FIG. 3B wherein the channel is open.
Figure 3B:
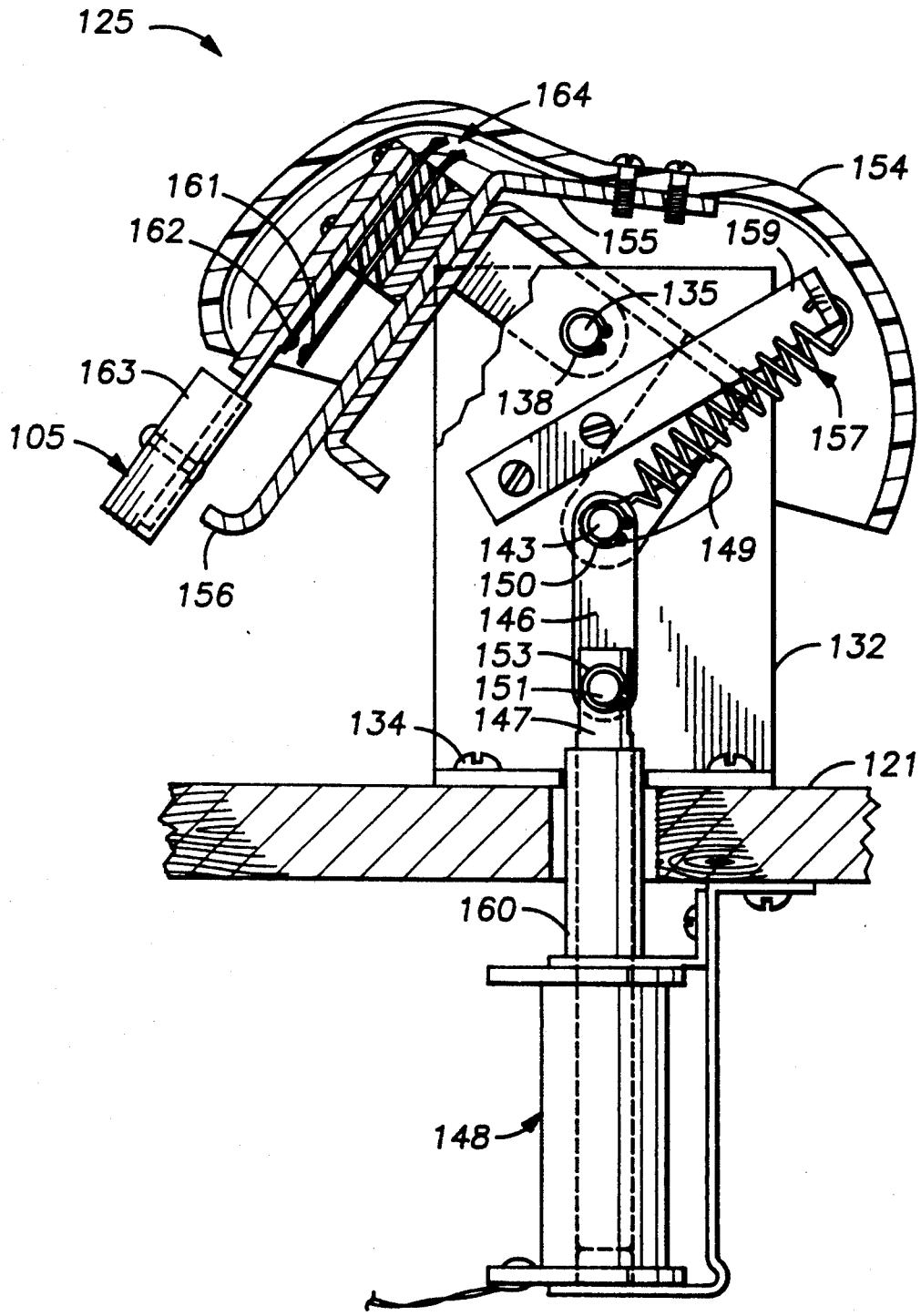

Continuing now on FIGS. 3A and 3B, it is shown that the swinging crank pin 143 swings within an arcuate slot 149 cut in the support 132, as also shown in FIG. 5B. A "C" snap-ring 150 keeps the link 146 connected to the swinging crank pin 143. In a similar fashion, the link 146 is connected to the solenoid plunger 147 by a pin 151 and "C" snap rings 152 and 153. When the solenoid 148 is energized, the solenoid plunger 147 pulls the crank pin 143 downward, causing the crank pin 143 to swing towards the left which raises the targets 105 and also raises the simulated animal head 154. The animal head 154 is screwed to a bracket 155 which is an extension of a stop 156 for a center one of the targets 105.

when the solenoid 148 is de-energized, a return spring 157 causes the crank pin 143 to swing upward, and the targets 105 return to their lower position. One end of the return spring 157 is connected to the crank pin 143 by a washer 158 shown in FIG. 2A and 2B. The other end of the return spring 157 is secured to the support 132 via a bracket 159. Instead of using a return spring 157, the front portion of the simulated animal head 154 could carry a weight tending to pivot the simulated animal head downward 154 towards the first position shown in FIG. 3A

It should be evident that when the solenoid 148 is energized to raise the targets 105 from the first position shown in FIG. 3A to the second position shown in FIG. 3B, a considerable amount of torque is placed on the solenoid plunger 147. Therefore, the upper portion of the solenoid plunger 147 is guided by a tube 160 of metal such as bronze that provides low friction with respect to the solenoid plunger 147 which is made of iron such as mild steel.

The targets 105 each include an electrical switch. As shown in FIG. 3A, for example, each switch includes a pair of contacts 161, 162 which close when the ball (102 in FIG. 1) strikes the target. The contacts 161 and 162 provide a electrical signal to switch terminals 164. As shown in FIG. 2A, the central target 163 has the switch terminals 164, a left target 165 has switch terminals 166, and a right target 167 has switch terminals 168.

Turning now to FIG. 6, there is shown a schematic diagram of a timer circuit for energizing the solenoid 148 for a predetermined duration of time beginning when any one of the targets 105 is struck by the ball 102. When the center target 163 is struck, an active low signal is developed across a pull-up resistor 169 and activates scoring circuits (not shown). Moreover, when any one of the targets is hit, an active low signal is asserted across a pull-up resistor 170. The pull-up resistors 169, 170 each have a value, for example, of 4.7K ohms. The left and right target switch terminals 166, 168 are wired in parallel and isolated from the central switch terminals 164 by directional diodes 171, 172.

To energize the solenoid 148 for a predetermined duration of time beginning when any one of the targets 105 is struck, a type 555 timer integrated circuit 173 receives the active low signal from the pull-up resistor 170 through a series resistor 174. The series resistor 174, for example, has a value of 4.7K ohms. The active low signal cause the timer integrated circuit 173 to trigger an actuating signal active high to a resistor 175 and transistor 176 which energizes the solenoid 148. The resistor 175, for example, has a value of 68 ohms. A directional diode 178 is connected in parallel with the coil of the solenoid 148 to suppress turn-off transients.

When the timer integrated circuit 163 is triggered, it rapidly discharges a timing capacitor 179. When the timing capacitor 179 has been discharged to a low threshold level, the integrated circuit 173 stops discharging the capacitor. The capacitor 179 is then recharged by a pull-up resistor 180. When the capacitor 179 becomes recharged to a high threshold level, the timer integrated circuit 173 de-asserts its output signal and thereby de-energizes the solenoid 148. The predetermined duration of time for energizing the solenoid 148 is therefore set by the product of the resistance of the resistor 180 and the capacitance of the capacitor 179. The resistor 180, for example, has a value of 1 megohm, and the capacitor 179 has a value of 33 microfarads, for example, so that the solenoid 148 is energized for a duration of about 30 seconds beginning when any one of the targets 105 is hit by the ball 102.

As described above, the present invention provides a way of enticing a player to attempt to direct the ball to a high scoring region of the playfield. The player, however, must direct the ball to strike one of the targets blocking the channel leading to the high scoring area. The players' attention is directed to the targets by a simulated animal head that is a prominent feature of the game. In response to the players' skill, the simulated animal head is raised to indicate that the channel has been opened.

Many modifications and variations of the present invention are possible in light of the above teachings. The function of the timing circuit shown in FIG. 6, for example, can be programmed into a microcomputer (not shown) that is conventionally used for keeping track of the players' score. The microcomputer could also be programmed to generate simulated animal head animal noises or flash lights such as LED lamps that provide eyes for the simulated animal head, for example, when the simulated animal head is raised or lowered. Moreover, the microcomputer could be programmed to shorten the duration of time that the simulated animal head is raised when the player has obtained a high score, so as to increase the difficulty of the game for more skillful players. In this fashion the pivoting gate and target assembly of the invention can maintain the interest of the more skillful players. The microcomputer could also be programmed to raise the simulated animal head only after all of the targets have been hit, or only after the targets have been hit in a particular sequence. The microcomputer, for example, could be programmed to select and indicate, via a selected one of a number of lamps (not shown) adjacent the respective targets, a particular one of the targets that must be hit to raise the simulated animal head.

To conserve power, a latching solenoid mechanism (not shown) could be used for raising the simulated animal head in lieu of the simple solenoid 148 shown in FIGS. 3A and 3B. A suitable latching solenoid mechanism is shown and described in Moravec U.S. Pat. No. 4,804,186 issued Feb. 14, 1989, incorporated herein by reference.

Although the invention has been described above in connection with a simulated animal head 154 shown in FIGS. 3A and 3B for covering the pivoting gate and target assembly 125, in general the appearance of the covering for the assembly 125 will be in accordance with a "theme" for the game 100. Instead of a simulated animal head, for example, the covering for the assembly 125 could have the appearance of an item of scenery such as a hill or mountain having a tunnel, and the targets 105 could have the appearance of stop signs.

What is claimed is:

1. A pinball machine comprising:

a playfield having a planar surface supporting a rolling ball of a predetermined diameter;

a channel on said planar surface between two regions of said planar surface of said playfield, said channel extending through two upstanding supports mounted on said playfield;

a pivoted member disposed above said channel and disposed above said planar surface by a distance greater than the predetermined diameter of said ball, said pivoted member being pivotally mounted to each of said upstanding supports at respective pivot points disposed above said planar surface by a distance greater than the predetermined diameter of said ball, and a plurality of targets mounted to said pivoted member and depending from said pivoted member, said targets having electrical switches responsive to said targets being struck by said ball;

an actuator connected to said pivoted member and activated by an electrical signal responsive to at least one of said targets for raising said targets from a first position, wherein the targets are positioned in the channel to interfere with passage of the ball through the channel, to a second position, wherein the targets are positioned above the channel so as not to interfere with passage of the ball through the channel.

2. The pinball machine as claimed in claim 1, further comprising a timer circuit responsive to said at least one of said targets for asserting said electrical signal for a predetermined period of time beginning when said at least one of said targets is struck by said ball.

3. The pinball machine as claimed in claim 1, wherein said actuator is a solenoid.

4. The pinball machine as claimed in claim 1, further comprising a cover simulating an animal's head and covering said upstanding supports.

5. The pinball machine as claimed in claim 1, further comprising a cover simulating an animal's head, said cover being mounted to said pivoted member so that said cover is pivoted up and down with said targets.

6. The pinball machine as claimed in claim 1, wherein said upstanding supports are a pair of parallel spaced planar brackets.

7. The pinball machine as claimed in claim 6, wherein at least one of said planar brackets defines an arcuate slot through which passes a crank pin coupling said targets to said actuator.

8. The pinball machine as claimed in claim 7, further comprising a link connecting said crank pin to said actuator.

9. A pinball machine comprising:

a playfield supporting a rolling ball;

a channel between two regions of said playfield, said channel extending through two upstanding supports mounted on said playfield;

a plurality of targets pivotally mounted to said upstanding supports, said targets having electrical switches responsive to said targets being struck by said ball; and an actuator connected to said targets and activated by an electrical signal responsive to at least one of said targets for raising said targets from a first position, wherein the targets are positioned in the channel to interfere with passage of the ball through the channel, to a second position, wherein the targets are positioned above the channel so as not to interfere with passage of the ball through the channel;

wherein said upstanding supports are a pair of parallel spaced planar brackets, and wherein at least one of said planar brackets defines an arcuate slot through which passes a crank pin coupling said targets to said actuator.

10. The pinball machine as claimed in claim 9, further comprising a link connecting said crank pin to said actuator.

11. A pinball machine comprising:

a playfield having a planar surface supporting a rolling ball of a predetermined diameter;

a channel on said planar surface between two regions of said planar surface of said playfield, said channel extending through two upstanding supports mounted on said playfield;

a pivoted member disposed above said channel and disposed above said planar surface by a distance greater than the predetermined diameter of said ball, said pivoted member being pivotally mounted to each of said upstanding supports at pivot points disposed above said planar surface, at least one target pivotally mounted to said pivoted member and depending from said pivoted member, said target having an electrical switch responsive to said target being struck by said ball, an actuator connected to said pivoted member and activated by an electrical signal responsive to said target for raising said target from a first position, wherein said target is positioned in the channel to interfere with passage of the ball through the channel, to a second position, wherein the target is positioned above the channel so as not to interfere with passage of the ball through the channel, and a cover covering said upstanding supports and said pivoted member and being mounted to said pivoted member so that said cover is pivoted up and down with said target.

12. The pinball machine as claimed in claim 11, further comprising a timer circuit responsive to said target for asserting said electrical signal for a predetermined period of time beginning when said target is struck by said ball.

13. The pinball machine as claimed in claim 11, wherein said actuator is a solenoid.

14. The pinball machine as claimed in claim 11, wherein said cover has the resemblance of an animal's head.

15. The pinball machine as claimed in claim 11, wherein said upstanding supports are a pair of parallel spaced planar brackets.

16. The pinball machine as claimed in claim 15, wherein at least one of said planar brackets defines an arcuate slot through which passes a crank pin coupling said targets to said actuator.

17. The pinball machine as claimed in claim 16, further comprising a link connecting said crank pin to said actuator.

* * * * *